US011684900B2

(12) United States Patent
Seiler

(10) Patent No.: US 11,684,900 B2
(45) Date of Patent: Jun. 27, 2023

(54) HYGIENIC MIXER WHICH IS PIVOTABLY MOUNTED

(71) Applicant: Maschinenfabrik Gustav Eirich GmbH & Co. KG, Hardheim (DE)

(72) Inventor: Andreas Seiler, Tauberbischofsheim (DE)

(73) Assignee: Maschinenfabrik Gustav Eirich GmbH & Co. KG, Hardheim (DE)

( * ) Notice: Subject to any disclaimer, the term of this patent is extended or adjusted under 35 U.S.C. 154(b) by 24 days.

(21) Appl. No.: 16/980,508

(22) PCT Filed: Mar. 8, 2019

(86) PCT No.: PCT/EP2019/055886
§ 371 (c)(1),
(2) Date: Sep. 14, 2020

(87) PCT Pub. No.: WO2019/175058
PCT Pub. Date: Sep. 19, 2019

(65) Prior Publication Data

US 2021/0016238 A1 Jan. 21, 2021

(30) Foreign Application Priority Data

Mar. 16, 2018 (DE) ..... 10 2018 106 189.7

(51) Int. Cl.
*B01F 29/64* (2022.01)
*B01F 29/80* (2022.01)
(Continued)

(52) U.S. Cl.
CPC ..... *B01F 29/64* (2022.01); *B01F 29/82* (2022.01); *B01F 35/451* (2022.01);
(Continued)

(58) Field of Classification Search
CPC ..... B01F 29/64; B01F 29/82; B01F 29/4033; B01F 29/4034; B01F 29/4032;
(Continued)

(56) References Cited

U.S. PATENT DOCUMENTS 1,756,078 A 4/1930 Aeschbach
4,042,221 A * 8/1977 Myers ..... B01F 33/70 366/267
(Continued)

FOREIGN PATENT DOCUMENTS

CN 101658770 A 3/2010
CN 102794205 A 11/2012
(Continued)

OTHER PUBLICATIONS

Russian Office Action issued in Russian patent application 2020133817, dated Sep. 28, 2021.
(Continued)

*Primary Examiner* — Charles Cooley
(74) *Attorney, Agent, or Firm* — Faegre Drinker Biddle & Reath LLP

(57) ABSTRACT

A mixing device includes a mixing container rotatable about a first axis of rotation for receiving mixing material, which has a mixer opening and a mixer cover which can be reciprocated between an opened position and a closed position. The mixer cover in the closed position closes the mixer opening and in the opened position exposes the mixer opening. The mixing container is rotatably mounted to a machine stand. The mixer cover is so fixed to the machine stand that the mixing container in the closed position of the mixer cover is rotatable relative to the mixer cover about the first axis of rotation. The machine stand has a stationary element and a pivotal element, wherein the pivotal element is mounted pivotably about a pivot axis relative to the
(Continued)

Figure 1:
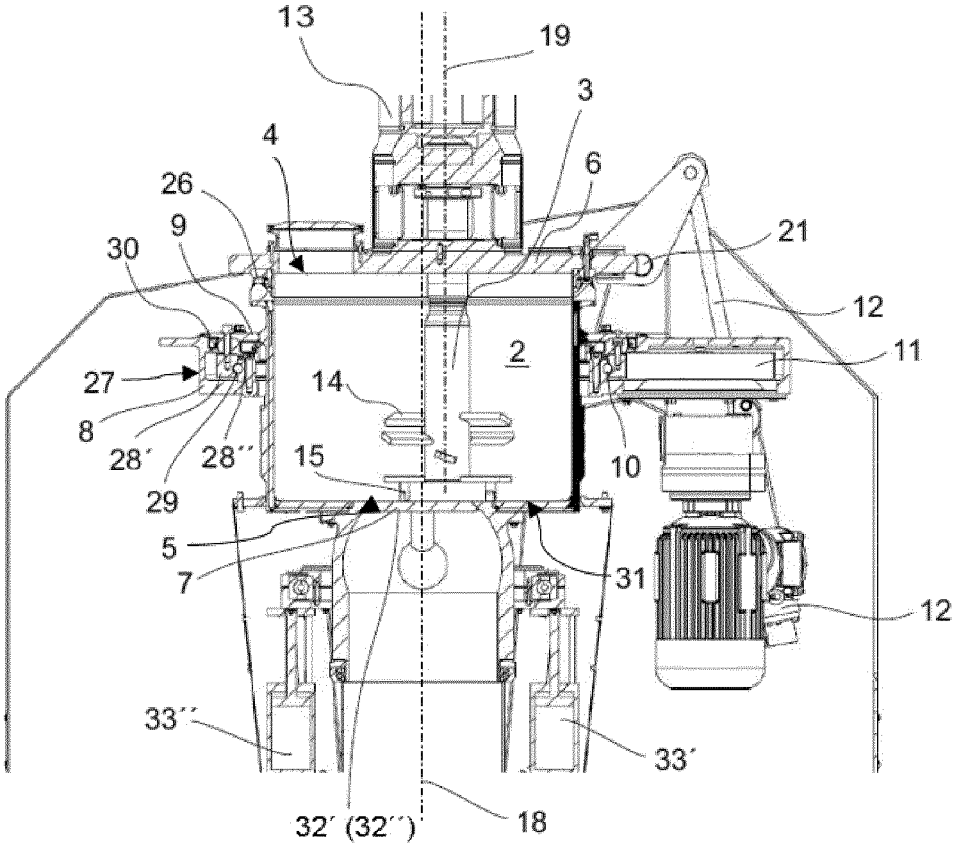

stationary element. The mixing container is mounted rotatably to the pivotal element and the mixer cover is fixed to the pivotal element.

12 Claims, 3 Drawing Sheets

(51) Int. Cl.
*B01F 35/45* (2022.01)
*B01F 35/75* (2022.01)
*B01F 29/00* (2022.01)

(52) U.S. Cl.
CPC ..... *B01F 35/7547* (2022.01); *B01F 29/4033* (2022.01); *B01F 29/4034* (2022.01); *B01F 2215/0422* (2013.01)

(58) Field of Classification Search
CPC .... B01F 29/83; B01F 35/451; B01F 35/7547; B01F 35/145; B01F 2101/06; B01F 2101/22; B01F 2215/0422; B01F 7/00933; B01F 7/00633; B01F 11/00; B01F 7/16; B01F 7/00208; B01F 15/00733; B01F 7/00275; B01F 7/1605; B01F 11/0017; B01F 13/00; B01F 7/001; B01F 13/0098; B01F 7/162; B01F 7/00; B01F 15/00; B01F 7/161; B01F 7/18; B01F 15/00006; B01F 15/00805; B01F 2015/00084; B01F 2015/00097
USPC ..... 366/54–55, 60–63, 92, 135, 187–188, 366/192, 219, 220–224
See application file for complete search history.

(56) References Cited

U.S. PATENT DOCUMENTS 4,048,473 A * 9/1977 Burkhart ..... A47J 27/004 219/389
4,560,283 A * 12/1985 Eirich ..... B01F 35/45 366/188
4,650,337 A 3/1987 Otto
4,854,715 A * 8/1989 Eirich ..... B01F 35/751 366/139
4,951,260 A 8/1990 Strehlow
5,492,401 A * 2/1996 Halsted ..... B28C 5/1862 366/47
5,865,538 A * 2/1999 Walker ..... B01F 29/64 366/209
6,241,380 B1 * 6/2001 Bornemann ..... B01F 33/35 366/217
6,669,360 B1 * 12/2003 Adelmann ..... F16K 27/07 366/347
8,678,639 B2 * 3/2014 Tolle ..... B01F 33/833 366/245
2001/0005338 A1 * 6/2001 Muhlbauer ..... B01F 33/5011 366/329.1
2004/0085854 A1 * 5/2004 Pauser ..... B01F 35/71 222/145.6
2004/0257909 A1 * 12/2004 Pieroni ..... B05C 17/00516 222/145.6
2011/0013479 A1 * 1/2011 Chaudhuri ..... B01F 29/40113 366/220
2011/0249527 A1 10/2011 Seiler et al.
2012/0301357 A1 11/2012 Gut et al.
2013/0016581 A1 1/2013 Doerr et al.
2014/0137748 A1 5/2014 Perentes et al.
2014/0251703 A1 * 9/2014 Marchand ..... B28C 5/085 180/53.4
2015/0005150 A1 1/2015 Meles
2015/0250187 A1 9/2015 Sakane et al.
2017/0172173 A1 6/2017 Navarro et al.
2018/0177339 A1 6/2018 Hua
2019/0255493 A1 * 8/2019 Rüberg ..... B01F 35/00
2020/0030762 A1 * 1/2020 Rüberg ..... B01F 27/1123

FOREIGN PATENT DOCUMENTS

CN 102869435 A 1/2013
CN 103826508 A 5/2014
CN 104280228 A 1/2015
CN 106163295 A 11/2016
DE 12 96 609 B 6/1969
DE 689 03 071 T2 2/1993
DE 10 2008 054 842 A1 7/2010
EP 2358467 B1 7/2014
GB 2000447 A * 1/1979 ..... B01F 15/0267
JP 59-142991 A 8/1984
JP 2001-206485 A 7/2001
JP 2002-165710 A 6/2002
JP 2003-117373 A 4/2003
JP 2012-512017 A 5/2012
JP 2014-108146 A 6/2014
KR 20-2010-0009100 U 9/2010
KR 10-2011-0097959 A 8/2011
SU 1472111 A1 4/1989
SU 1607682 A3 11/1990
WO WO-2010015496 A1 2/2010
WO WO-2016/206625 A1 12/2016
WO WO-2019175048 A1 * 9/2019 ..... B01F 15/00448
WO WO-2019175049 A1 * 9/2019 ..... B01F 15/00435
WO WO-2019175054 A1 * 9/2019 ..... B01F 15/00448
WO WO-2019175058 A1 * 9/2019 ..... B01F 15/00019

OTHER PUBLICATIONS

Chinese Office Action issued in Chinese patent application No. 201980019845.6, dated Dec. 27, 2021.

* cited by examiner

HYGIENIC MIXER WHICH IS PIVOTABLY MOUNTED

CROSS-REFERENCE TO PRIOR APPLICATIONS

This application is a § 371 National Stage Application of PCT International Application No. PCT/EP2019/055886 filed Mar. 8, 2019, which claims priority to German Application No. 10 2018 106 189.7 filed on Mar. 16, 2018, both of which are incorporated herein in their entirety.

The present invention concerns a mixing device, in particular a hygienic mixing device for the production of foodstuff products and pharmaceuticals. The mixing device has a mixing container for receiving mixing material and a mixer cover which can close a mixer opening of the mixing container, wherein the mixing container is mounted in the closed position rotatably relative to the mixer cover. Such mixing devices also usually have a rotatable mixing tool in the interior of the mixing container.

The aim and purpose of a mixing device is generally to thoroughly mix the mixing material in a mixing container to the best possible degree. Frequently however there are certain locations within the mixing container, at which mixing material collects and possibly sets during the mixing operation. Such locations which generally do not have mixing material flowing directly over same are often to be found at edge surfaces, seals and in particular at the mixer cover which is stationary relative to the mixing container. Consequently the mixing material accumulated at those locations no longer takes part in the mixing process.

In addition the fact that the mixing material adheres to locations which are not moved or which do not have the mixing material passing over same can result in residues which are left behind in the mixing container when it is emptied. That gives an increased risk of contamination to subsequent batches by virtue for example of growing bacteria cultures or cross-contamination upon a change in product, and that entails increased cleaning operations and consequently also higher costs in the product production process.

Frequently in operation the mixing container rotates about an axis of rotation. Depending on the preparation processes carried out in the mixing container like for example dry mixing, granulation or suspension different angles of inclination of the rotating mixing container can in that case permit particularly efficient preparation. The term angle of inclination is used to mean the angle which the axis of rotation of the rotating mixing container includes with the vertical.

Thus an angle of inclination of about 20° to 30° is generally used for granulation. The inclination of the mixing container means that the mixing material is exposed to an additional downward shearing force whereby this produces an additional rolling movement of the mixing material, which produces particularly spherical granules. In the preparation of runny suspensions in turn an orientation of the mixing container which is horizontal or is inclined only through a few degrees (<5°) is necessary to avoid liquid accumulating at the lowest point in the mixing container. In the case of dry mixing operations inclinations of about 10° to 15° have in turn proven to be particularly advantageous for achieving efficient and complete mixing and particularly quick and complete emptying.

A mixing tool which does not also rotate with the mixing container is generally additionally arranged within the mixing container to further improve the degree of mixing. The mixing tool however preferably rotates about its own axis of rotation which is generally arranged at a certain spacing from the axis of rotation of the mixing container and parallel thereto. Such a mixing tool is frequently in the form of a mixing shaft.

In situations involving high hygiene requirements like for example in the production of foodstuffs and pharmaceuticals it is also necessary that the mixing container can also be completely and sealingly closed. Therefore mixing devices in such areas of use generally have a mixer cover which can close and seal off the mixing container. To afford the option of being able to fix a mixing tool which is not intended to also rotate with the mixing container to the mixer cover the mixer cover therefore also has to be so designed that it does not also rotate with the mixing container during operation.

DE 10 2008 054 842 A1 discloses for example a mixing device which has some of the above-mentioned features. That German patent application discloses a rotating mixing container with a housing cover which does not also rotate therewith and to which a rotating mixer shaft is fixed. In that case the housing cover however does not completely close off the mixing container and there is no provision of a device for changing the angle of inclination.

Known mixing devices generally involve a fixedly predetermined angle of inclination which can be varied, if at all, only in a highly complicated procedure and by virtue of structural modifications to the device. The consequence of this is that the angle of inclination of the mixing container is generally invariable after initial installation of the mixing device and in particular cannot be changed during operation or for cleaning purposes.

It has been found in practice however that known mixing devices can be cleaned and inspected only with the utmost difficulty and involving a complicated procedure. Particularly in areas of application involving high levels of hygiene requirement it is also particularly important that as far as possible all regions of the mixing device can be inspected by the user and can be easily and properly reached for cleaning purposes. None of the mixing devices known from the state of the art permit that.

The object of the present invention is therefore to provide a mixing device, the angle of inclination of which is particularly easy to adjust by the user and which can be particularly easily cleaned and inspected by the user.

According to the invention that object is attained by a mixing device having the features of claim 1.

The mixing device according to the invention has a mixing container rotatable about a first axis of rotation for receiving mixing material. That mixing container has a mixer opening, wherein there is provided a mixer cover which can be reciprocated between an opened position and a closed position. In the closed position the mixer cover closes the mixer opening and in the opened position the mixer cover exposes the mixer opening. In addition the mixing device has a machine stand in which the mixing container is rotatably or pivotably mounted. In that case the mixer cover is fixed to the machine stand in such a way that, upon a rotation of the mixing container in operation in the closed position the mixer cover does not have to also rotate with the mixing container. According to the invention the machine stand has a stationary element and a pivotal element. The pivotal element is mounted pivotably about a pivot axis relative to the stationary element and the mixing container is mounted rotatably to the pivotal element, the mixer cover being fixed to the pivotal element. Preferably a sliding seal is arranged between the mixer cover and the mixing container—in a closed position of the mixer cover— so that the mixer cover can sealingly close the mixing container in spite of the relative rotary movement thereof.

With such a mixing device the user can set a desired angle of inclination by a pivotal movement of the pivotal element about the pivot axis. In addition by virtue of a pivotal movement about the pivot axis the user can increase accessibility to regions of the mixing device which are normally inaccessible or difficult to access, whereby cleaning and inspection of the mixing device is simplified. In that respect by virtue of the mixer cover being fixed to the pivotal element it is possible to pivot the mixer cover without it also rotating with the mixing container in a closed position upon operational rotation of the mixing container.

In a preferred embodiment the pivot axis passes through the mixing container. A mixing container is generally a vessel having a cylindrical outside wall, a substantially circular vessel bottom and a circular mixing container opening opposite to the vessel bottom. In such or similar mixing containers the pivot axis preferably passes through the third of the mixing container that—in relation to the extent of the mixing container along the axis of rotation—is closest to the mixer opening.

It has been found that mounting the pivot axis in a position in which it extends through the mixing container reduces the inertia of the pivotal element in most cases. As a result the mechanical demands on a pivot bearing, by way of which the pivotal element is supported, are reduced. In addition the pivotal space necessary for the pivotal movement is reduced.

In a further preferred embodiment the pivotal element is pivotable with respect to the pivot axis at least through up to 90°, preferably at least up to 180° and particularly preferably through up to 360°.

The pivotal range of 90° generally makes it possible on the one hand to set the angle of inclination which is commonplace for the mixing operation and on the other hand to pivot the mixing container in such a way that cleaning and inspection of the container interior is simplified. In particular if the mixing container can be pivoted from a vertical into a horizontal position—in other words through 90°—then cleaning and inspection of the interior is particularly simple in the horizontal position. With a pivotal range of up to 180° on the one hand accessibility to the pivotal element is enhanced. If in that case the mixing container is pivotable from a substantially vertical position into an opposite vertical position then on the other hand the mixing opening can be employed to empty the mixing container by using the force of gravity. A pivotal range of 360° affords all the above-mentioned advantages and irrespective of the state and positioning of the mixing device permits comprehensive accessibility to the pivotal element and thus all units of the mixing device and that is extremely advantageous for example in cleaning and maintenance operations.

In a particularly preferred embodiment the first axis of rotation and the pivot axis are arranged perpendicularly to each other and preferably intersect at a point.

That measure also leads to a compact structure and a reduction in the necessary pivotal space.

In a further embodiment the mixer opening is circular and the mixing container is rotationally symmetrical with respect to the first axis of rotation, more specifically is preferably at least portion-wise cylindrical and/or conical. Preferred embodiments have in particular cylindrical mixing containers with a flat bottom or conical, cylindrical or cylindrical-conical mixing containers with a flat or convexly or concavely shaped bottom, for example dished bottoms.

By virtue of the mixing container being of a rotationally symmetrical configuration it can be very easily rotatably mounted. In addition the circular configuration of the mixer opening facilitates mounting and sealing of the mixer cover in relation to the mixing container because it does not also rotate with the mixing container in operation when the mixer cover is in a closed position.

In a further preferred embodiment the mixing container has a flange. The flange has a surface facing towards the mixer opening and a flange facing away from the mixer opening and is generally at the outside wall of the mixing container. Particularly preferably the flange extends completely around the outside wall of the mixing container. In addition there is provided a rotary bearing which preferably connects the surface of the flange, that faces in a direction away from the mixer opening, to the pivotal element. The mixing container is mounted rotatably about the first axis of rotation by way of that rotary bearing. In that arrangement the rotary bearing can be for example in the form of a ball bearing.

By virtue of the rotary bearing arrangement for the mixing container on a flange that bearing arrangement in principle can be moved to any position of the mixing container with respect to the axis of rotation. In practice in particular a flange that has been found to be particularly advantageous is one which is disposed in the third of the mixing container, that is closest to the mixer opening, with respect to the axis of rotation.

The rotary bearing arrangement involving a flange also has the advantage that a rotary bearing arrangement on the mixing container bottom, as is frequently to be found in other mixing devices, is eliminated. The mixing container bottom is thus in principle freely accessible from below and can be provided for example with a double casing for mixing container cooling or mixing material cooling with a concentric liquid feed and discharge by way of the first axis of rotation, or however with an emptying opening. The emptying opening is preferably smaller than the mixer opening. Mounting the rotary bearing to the surface of the flange, that faces away from the mixer opening, further provides for first screening of the rotary bearing from the mixer opening. That prevents lubricant, for example grease or oil, that is used for lubricating the rotary bearing and/or the associated drive, being able to reach the mixer opening during operation.

Alternatively however the rotary bearing can also be mounted at the other surfaces of a flange, in particular also the surface facing towards the mixing container opening. That can be advantageous for example when mounting to the surface facing away from the mixer opening is not possible by virtue of a lack of space due to the structure involved.

In a particularly preferred embodiment the rotary bearing is surrounded by a housing which is sealed in relation to the escape of lubricant (oil-tight or lubricant-tight housing). In that case at the intersections in relation to the pivotal element and the mixing container respectively, the housing can have seals which seal off the rotary bearing relative to the exterior. The housing can for example also be formed by suitable configurations for the flange and the pivotal element and by virtue of seals arranged between the individual elements.

In a further embodiment the mixer cover has a mixing element (mixing tool), preferably a mixer shaft, which is mounted rotatably with respect to the mixer cover in relation to a second axis of rotation. That mixing element is of such a configuration and is arranged on the mixer cover in such a way that in a closed position of the mixer cover, the mixing element is disposed within the mixing container, wherein the second axis of rotation is preferably parallel and particularly preferably parallel but not identical to the first axis of rotation. In that case the speed of rotation of the mixing element can be selected irrespective of the speed of rotation of the mixing container.

In addition a scraper element or a scraper device can also be arranged on the mixer cover in such a way that it is disposed within the mixing container in a closed position of the mixer cover. In that arrangement the longitudinal direction of the scraper element preferably extends parallel to the inside wall of the mixing container. Particularly preferably the scraper element (and also the mixing element) has strips or slats of an elastic material which, in a closed position of the mixer cover, are in contact with the inside of the mixing container (inter alia the inside wall and the bottom). The scraper element is movable relative to the mixing container, wherein preferably the scraper element is rigidly connected to the mixer cover which does not also rotate and the mixing container in operation moves relative to the scraper element by virtue of the rotation of the mixing container.

More thorough mixing of the mixing material is caused by a mixing and/or scraper element of the described kind. As the mixing and scraper element is fixed to the mixer cover it itself does not also rotate with the mixing container in operation thereof. The mixing material in the mixing container is therefore displaced in a relative movement with respect to the mixing and scraper element by virtue of the rotation of the mixing container. This on its own already provides for good thorough mixing. If the mixing element is now rotated with respect to the second axis of rotation that adds a second superimposed mixing movement, whereby the efficiency of the mixing device is markedly improved.

By virtue of the mixing and scraper element being fixed to the mixer cover the mixing and scraper element is also correspondingly pivoted when a pivotal movement takes place.

The above-described strips or slats pass over parts of the inside of the mixing container and thereby additionally provide that no residues of the mixing material are formed at the inside of the mixing container. Particularly preferably the total height of the inside wall and at least the radially outer part of the mixing container bottom have the scraper element passing thereover.

The rotation of the mixing element is generally produced by way of a drive also arranged on the mixer cover. In that case the drive is disposed on the side of the mixer cover, that is away from the mixer opening, and drives a mixer shaft which, in a closed position of the mixer cover, projects through the mixer cover into the mixing container.

In a particularly preferred embodiment the pivotal element has a holding frame with rotary bearing for mounting the mixing container and at least one and preferably two shaft portions respectively connected to the holding frame on opposite sides thereof. The holding frame is so designed that it at least partially surrounds the mixing container. The stationary element also has one or two pivot bearings in which the shaft portion or portions of the holding frame is or are respectively pivotably mounted. Alternatively the pivot bearings can also be arranged on the holding frame and the shaft portions on the stationary element.

This first embodiment is distinguished in that the pivotal element is of a particularly simple structure which saves on material. The holding frame can in particular be constructed in the form of an annular element so that it can be connected by way of a rotary bearing to a circular flange on the mixing container.

In a particularly preferred embodiment the mixing device is provided with a hydraulic or pneumatic device connected both to the stationary element and also to the pivotal element. The hydraulic or pneumatic device, for example a hydraulic piston drive, is provided to drive a pivotal movement of the pivotal element about the pivot axis. Therewith it is possible either to set a desired angle of inclination or also to drive a continuous pivotal movement, for example a swing movement.

Particularly for situations in which a continuous pivotal movement of the pivotal element is not necessary a hydraulic or pneumatic drive has proven to be advantageous for controlling the pivotal movement. It represents a stable and inexpensive option for driving the pivotal movement. In addition the pivotal element can also be easily and stably fixed with a hydraulic or pneumatic device at a desired deflection—that is to say at a desired angle of inclination of the mixing container. Alternatively one or more gear motors or other known drive systems for producing a rotary or pivotal movement can also be used for implementing the pivotal movement.

In a further embodiment the mixer cover is mounted hingedly with respect to the mixer opening, wherein preferably a drive, for example a gear motor, and particularly preferably a hydraulic or pneumatic device, is arranged at the pivotal element, for reciprocating the mixer cover between the closed and opened positions.

A hinged mixer cover is extremely advantageous for the user as often a single handle is sufficient to fit the cover on the mixing container in matching relationship and to close the mixer opening. Complicated and laborious adjustment of the mixer cover when closing the mixing container is therefore eliminated. If the hinged closure mechanism is additionally equipped with a drive then the touch of a button is generally sufficient to open and close the mixer cover. Other solutions like for example a mixer cover fixed to a gripping arm are admittedly also conceivable, in which respect however they would cause a higher degree of complication in regard to positioning and control as well as cost, in terms of the closing movement. In addition the cover would have to be held closed by way of a force-locking or positively locking connection, for example by screw means. In the case of a hinged closure mechanism equipped with a drive or a hydraulic or pneumatic device the drive for hinging the cover can also be used for continuously securely holding the mixer cover in the closed state during operation of the mixer, for example by constantly maintaining the pressure or the stressing force.

In a preferred embodiment the mixing container has a closable emptying opening which is of such an arrangement and configuration that the first axis of rotation passes through the emptying opening, particularly preferably centrally. In addition there is an emptying cover which can be reciprocated between an opened position and a closed position, wherein the emptying cover in the closed position closes the emptying opening and in the opened position exposes the emptying opening.

Such an emptying opening has the advantage that the mixing container does not have to be pivoted for the emptying operation, to empty the mixing container by way of the mixer opening. The emptying opening can be arranged for example above a conveyor belt or production line so that the finished mixture can be immediately discharged by way of the emptying opening and further transported by way of the conveyor belt.

In a particularly preferred embodiment the mixing device has a drive which is fixed to the pivotal element and is provided to reciprocate the emptying cover between the closed and opened positions. In that case the emptying cover is so arranged on the mixing container that the emptying cover is rotatable together with the mixing container about the first axis of rotation relative to the pivotal element. The emptying cover is preferably in the form of a ball segment valve.

Mounting the emptying cover in that way has the consequence that the emptying cover also rotates with the mixing container in operation upon a rotary movement of the mixing container.

Arranging the drive on the pivotal element is also particularly advantageous as the drive is admittedly subjected to a pivotal movement of the pivotal element, but not the rotary movement of the mixing container. That markedly facilitates mounting and power supply, in particular the cable arrangement for the drive.

By way of example the emptying cover can be in the form of a ball segment valve and the drive can be in the form of a linear drive, for example a hydraulic or pneumatic piston drive. The linear movement of the piston is then converted by way of a cam disc rotating with the mixing container into a rotary movement of a ball segment which is in the form of a ball segment of the ball segment valve so that rotation of the ball segment in the one direction causes closing of the emptying opening and in the other direction causes opening of the emptying opening.

Figure 2:
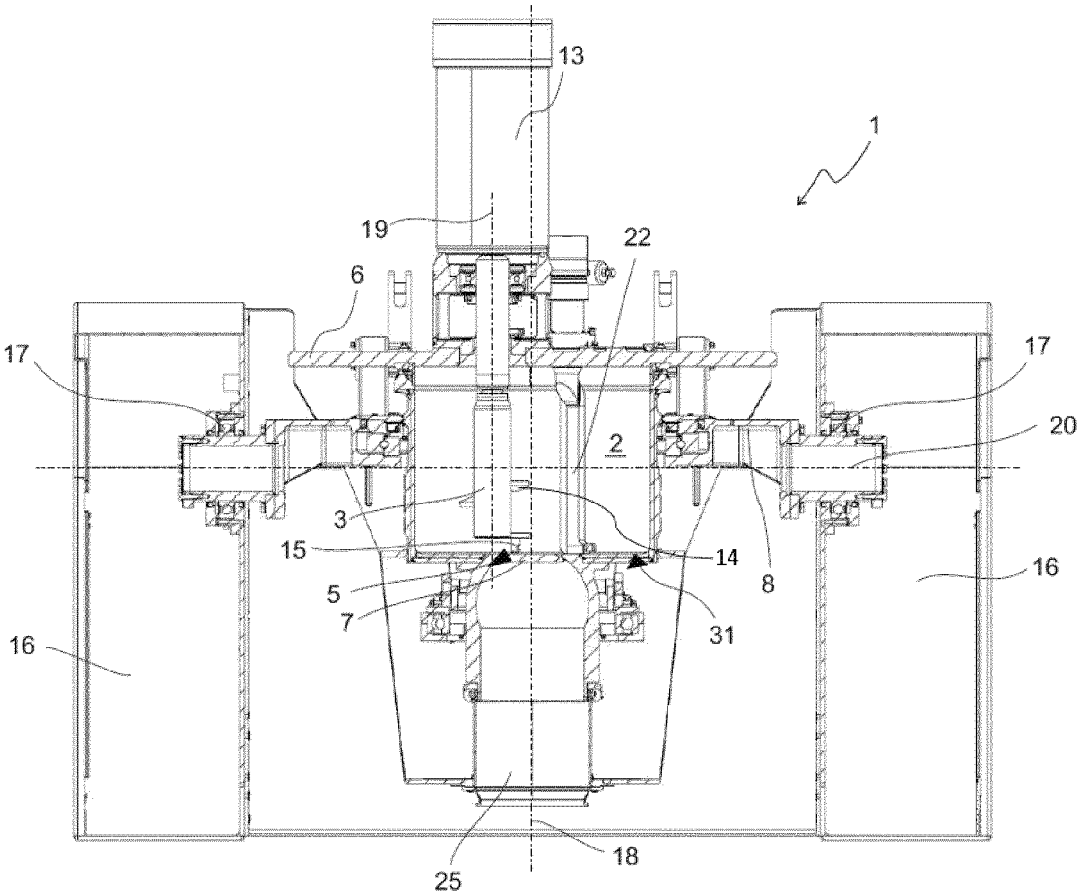
Figure 3:
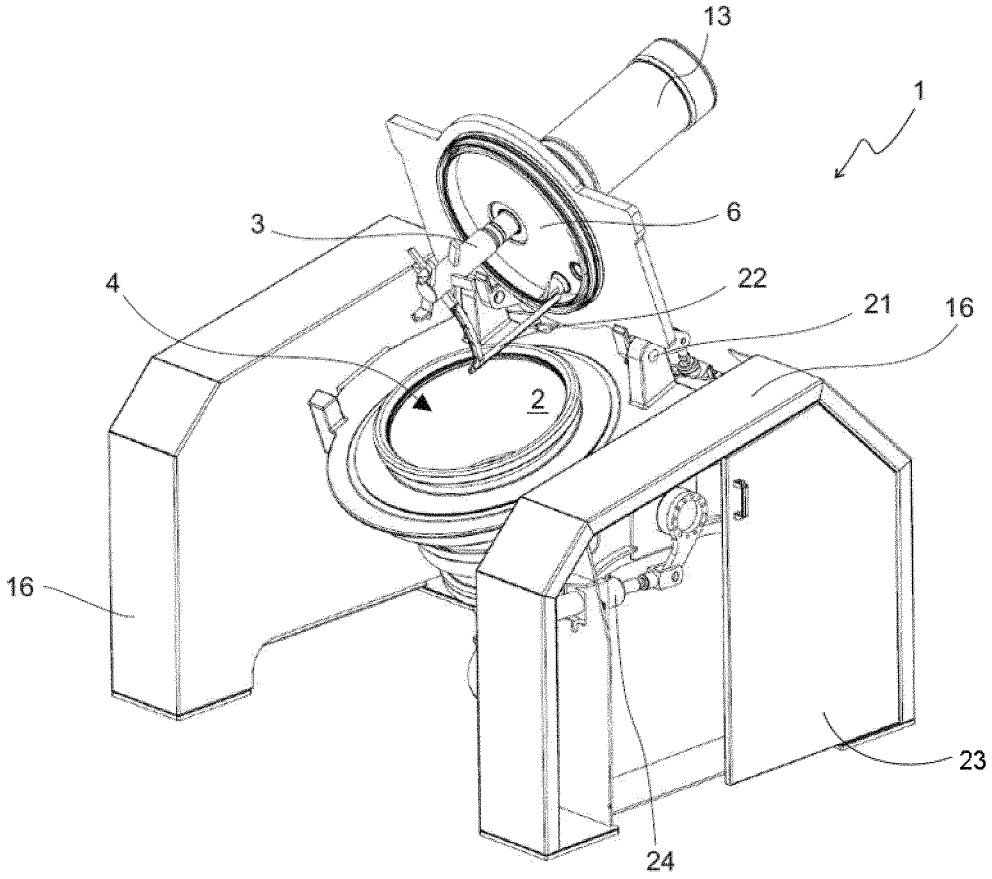

Further advantages, features and possible uses of the present invention will be clearly apparent from the following description of a preferred embodiment and the accompanying Figures in which:

FIG. 1 shows a sectional view of the mixing container according to the invention, FIG. 2 shows a sectional view of the mixing device according to the invention, and FIG. 3 shows a perspective view of the mixing device according to the invention.

FIG. 1 shows a sectional view of the mixing container 2 and the components of the mixing device 1, that adjoin the mixing container 2. In this case the mixing container 2 is in a vertical position, that is to say at an angle of inclination of 0°. The mixer opening 4 is at the upper end of the mixing container 2 and the emptying opening 5 is at the lower end. The mixer opening 4 in this view is closed by the mixer cover 6. FIG. 1 accordingly shows a part of the mixing device 1 in a closed position of the mixer cover 6. The emptying opening 5 is also closed by the emptying cover 7. This accordingly is also a view of the closed position of the emptying cover 7.

The emptying cover 7 shown here is in the form of a ball segment valve which is arranged on the mixing container 2 and in operation also rotates therewith. In this case the emptying cover 7 is composed of two ball portion segments 32' and 32" (not explicitly shown) which can each be pivoted by a linear movement of the respective hydraulic piston drives 33' and 33". The hydraulic piston drives 33' and 33" do not also rotate in operation with the mixing container 2. Consequently by virtue of a pivotal movement of the ball segments 32' and 32" the emptying cover 7 can be moved from an open position into a closed position or from a closed position into an open position. The corresponding 'second' pivot axis about which the pivotal movement of the emptying cover 7 occurs is preferably perpendicular to the first axis of rotation 18 and also rotates with the mixing container 2.

In the illustrated embodiment of the mixing device 1 the mixing container 2 has a flange 9. A ball bearing 10 is arranged on the side/surface of the flange 9, that faces away from the mixer opening 4. The flange 9 is connected to a seal 30 and a first ball bearing rail 28' which in turn is mounted rotatably by way of a ball element 29 relative to a second ball bearing rail 28". The second ball bearing rail 28" is fixed to a holding frame of the pivotal element 8, in the form of part of the pivotal element. The ball bearing 10 is surrounded by the holding frame of the pivotal element 8, the flange 9 and the seal 30 in such a way that the assembly of those components 8, 9 and 30 delimit the ball bearing from the exterior in oil-tight relationship, more precisely in lubricant-tight relationship. The assembly of the components 8, 9 and 30 therefore forms a lubricant-tight housing 27.

The ball bearing 10 is set in movement by way of the drive 11 whereby the rotation of the mixing container is driven about the first axis of rotation 18.

The mixer cover 6 shown in FIG. 1 bears at the mixer opening 4 against the edge surfaces of the mixing container 2 by way of a seal 26. The seal 26 is a sliding seal. The mixer cover 6 is also supported by way of a hinge 21 which can be actuated by way of a hydraulic device 12. In that way a reciprocating movement is produced between an opened and a closed position of the mixer cover 6. For that purpose the hydraulic device 12 is connected on the one hand to the mixer cover 6 (the hinge 21 of the mixer cover 6) and on the other hand to the holding frame of the pivotal element 8. Upon a pivotal movement of the pivotal element 8 the hydraulic device 12 together with the mixer cover 6 therefore performs the same pivotal movement as the pivotal element 8.

In addition arranged on the mixer cover 6 is a mixer shaft 3 projecting into the interior of the mixing container 2. The mixer shaft can be caused to rotate about the second axis of rotation 19 by way of the drive 13 which is also arranged on the mixer cover. In addition blades 14 and bottom scrapers 15 are fixed to the mixer shaft 3. The blades 14 produce efficient thorough mixing of the mixing material in operation of the mixing device 1. The bottom scrapers 15 end in the proximity of the mixing container bottom 31 and are of such a design that in operation of the mixing device 1 the bottom scrapers 15 pass over the mixing container bottom 31 so that mixing material which has accumulated at the mixing container bottom 31 is detached therefrom without damage to the mixing container bottom 31 by virtue of the bottom scrapers 15 passing over same. The bottom scrapers 15 can be in the form of strips or slats of an elastic material or however also a rigid material like for example a plastic.

FIG. 2 shows a sectional view of the entire mixing device 1. The first axis of rotation 18, the second axis of rotation 19 and the pivot axis 20 are shown in this view. In the illustrated embodiment the first axis of rotation 18 and the second axis of rotation 19 are arranged parallel to each other but spaced. That is also referred to as an asymmetrical arrangement of the mixer shaft 3. Fixedly connected to the mixer cover 6 is the scraper device 22 which is supported in overhung relationship and which extends along the mixing container wall to the mixing container bottom 31. Upon rotation of the mixing container 2 about the first axis of rotation 18 then accordingly solely by virtue of that rotational movement the mixing material is caused to flow on to the mixer shaft 3 and the scraper device 22. The blades 14 of the mixer shaft 3 like also the scraper device 22 therefore on their own produce a thorough mixing effect by virtue of that relative movement, even when the mixer shaft itself does not perform a rotational movement. If however the mixer shaft 3 is driven in rotation about the second axis of rotation 19 that causes additional mixing of the mixing material. In that case in particular the bottom scrapers 15 can be of such an arrangement and configuration that, after a given number of revolutions of the mixing container 21 and a given number of revolutions of the mixer shaft 3 every location of the mixing container bottom 31 has had a bottom scraper 15 pass thereover at least once.

FIG. 2 also shows the machine stand 16. In the illustrated embodiment this comprises two stands which are arranged on two opposite sides of the pivotal element 8 and in which a respective pivot bearing 17 is disposed. The pivotal element 8 is thus mounted pivotably about the pivot axis 20 by way of the pivot bearings 17. The pivot axis 20 is arranged perpendicularly to the first axis of rotation 18 and consequently also perpendicularly to the second axis of rotation 19.

FIG. 2 also shows a material transfer conduit 25 which is arranged in the lower region of the pivotal element and adjoins the emptying opening 5 of the mixing container 2. Mixing material which has been correspondingly thoroughly mixed in the mixing container 2 can thus be discharged by way of the emptying opening 5 into the material transfer conduit 25 and from there transferred for example on to a conveyor belt.

FIG. 3 shows a perspective view of the entire mixing device 1. In this case the mixing device 1 is shown with the mixer cover 6 in an open position. In addition in this view the mixing container 2 is inclined through an angle of inclination of about 20° so that the pivotal element is pivoted through about 20° in the direction towards the viewer. It will be apparent from this view that the angle of inclination can be easily set to any desired value by a pivotal movement about the pivot axis.

The hinged mixer cover 6 is opened in FIG. 3 in such a way that the mixer shaft 3 is disposed outside the mixing container 1 and the mixer opening 4 is completely visible. By virtue of the hinged mounting of the mixer cover 6 by way of the hinge 21 the mixer cover 6 can be easily pivoted open and shut. That mechanism can be particularly clearly seen in FIG. 3.

Besides the mixer shaft 3 with its drive 13 the perspective view in FIG. 3 shows the scraper device 22 which is also fixed to the mixer cover 6. Therefore like the mixer shaft 3 upon a rotation of the mixing container 2 the scraper device 22 does not also rotate with same and projects into the mixing container 2 when the mixer cover 6 is in a closed position. The scraper device 22 for example has a respective rail which comprises an elastic material and which, with the mixer cover 6 in a closed position, is in contact with the lateral inside wall of the mixing container 2. As a result upon rotation of the mixing container in operation the inside of the mixing container is completely freed of mixing material, thereby preventing the formation of mixing material residues while in addition achieving a further increase in the degree of mixing.

The drive 24 for the pivotal movement of the pivotal element is visible in the machine stand 16 on the side towards the viewer. Accessibility to the drive for maintenance operations is afforded by the doors 23 (partly faded out) of the machine stand 16.

LIST OF REFERENCES

1 mixing device
2 mixing container
3 mixing element/mixer shaft
4 mixer opening
5 emptying opening
6 mixer cover
7 emptying cover
8 holding frame/pivotal element
9 flange
10 rotary bearing/ball bearing
11 drive for mixing container
12 hydraulic device (drive) for mixer cover
13 drive for mixer shaft
14 blade
15 bottom scraper
16 machine stand
17 pivot bearing
18 first axis of rotation
19 second axis of rotation
20 pivot axis
21 hinge
22 scraper device
23 door
24 drive pivotal element
25 material transfer conduit
26 seal
27 lubricant-tight (oil-tight) housing
28' 28" ball bearing rail
29 ball element
30 seal
31 mixing container bottom
32',32" ball segment of a ball segment valve
33',33" hydraulic piston drive for emptying cover

The invention claimed is:

1. A mixing device comprising a mixing container rotatable about a first axis of rotation for receiving mixing material, which has a mixer opening and a mixer cover which can be reciprocated between an opened position and a closed position, wherein the mixer cover in the closed position closes the mixer opening and in the opened position exposes the mixer opening, wherein there is provided a machine stand in which the mixing container is rotatably mounted and to which the mixer cover is so fixed that the mixing container in the closed position of the mixer cover is rotatable relative to the mixer cover about the first axis of rotation, wherein the machine stand has a stationary element and a pivotal element, wherein the pivotal element is mounted pivotably about a pivot axis relative to the stationary element, wherein the mixing container is mounted rotatably to the pivotal element and the mixer cover is fixed to the pivotal element, wherein the first axis of rotation and the pivot axis are arranged perpendicularly to each other, wherein the mixing container has a flange with a surface facing towards the mixer opening and a surface facing away from the mixer opening and there is provided a rotary bearing which connects the pivotal element to the surface of the flange that faces away from the opening; and wherein the mixing container is mounted rotatably about the first axis of rotation by way of that rotary bearing.

2. The mixing device according to claim 1, wherein the pivot axis passes through the mixing container.

3. The mixing device according to claim 1, wherein the pivotal element is pivotable with respect to the pivot axis at least through up to 90°.

4. The mixing device according to claim 1, wherein the mixer opening is circular and the mixing container is rotationally symmetrical with respect to the first axis of rotation.

5. The mixing device according to claim 1, wherein the pivotal element has a housing which is sealed in relation to the escape of lubricant and which surrounds the rotary bearing.

6. The mixing device according to claim 1, wherein the mixer cover has a mixing element which is mounted rotatably with respect to the mixer cover in relation to a second axis of rotation and which is of such a configuration and arrangement that in the closed position of the mixer cover said mixing element is within the mixing container.

7. The mixing device according to claim 6, wherein the second axis of rotation is parallel to the first axis of rotation.

8. The mixing device according to claim 1, wherein the pivotal element has a holding frame with said rotary bearing for mounting the mixing container, wherein the holding frame at least partially surrounds the mixing container, and there are provided at least a shaft portion and a pivot bearing, wherein the shaft portion is mounted pivotably in the pivot bearing and either the shaft portion is fixed to the holding frame and the pivot bearing is fixed to the stationary element or the shaft portion is fixed to the stationary element and the pivot bearing is fixed to the holding frame.

9. The mixing device according to claim 1, wherein the mixing device has a drive device which is connected both to the stationary element and also to the pivotal element, and is provided to permit pivotal movement of the pivotal element about the pivot axis.

10. The mixing device according to claim 1, wherein the mixer cover is hingedly mounted with respect to the mixer opening.

11. The mixing device according to claim 10, wherein arranged on the pivotal element is a drive device provided to reciprocate the mixer cover between the closed and opened positions.

12. The mixing device according to claim 1, wherein the mixing container has a closable emptying opening which is of such an arrangement and configuration that the first axis of rotation passes through the emptying opening and there is provided an emptying cover which can be reciprocated between an opened position and a closed position, wherein the emptying cover closes the emptying opening in the closed position and exposes the emptying opening in the opened position.

* * * * *